United States Patent [19]

Baron

[11] 4,278,393

[45] Jul. 14, 1981

[54] SLACK PREVENTION SYSTEM FOR A CROWD ROPE OF A POWER SHOVEL

[75] Inventor: George B. Baron, Marion, Ohio

[73] Assignee: Dresser Industries, Inc., Dallas, Tex.

[21] Appl. No.: 966,336

[22] Filed: Dec. 4, 1978

[51] Int. Cl.[3] ..... B66D 1/48

[52] U.S. Cl. ..... 414/690; 212/149; 254/270; 414/694

[58] Field of Search ..... 414/690-694; 254/185; 212/39, 59 R, 58 R, 8 R, 8 A, 8 B, 149, 262; 37/117.5

[56] References Cited

U.S. PATENT DOCUMENTS

| | | | |
|---|---|---|---|
| 2,380,625 | 7/1945 | Zeilman et al. | 414/690 |
| 2,543,765 | 3/1951 | Davidson et al. | 254/185 |
| 2,832,485 | 4/1958 | Schneider | 414/691 |
| 3,346,129 | 10/1967 | Carter et al. | 414/690 |
| 3,843,095 | 10/1974 | Rupert | 414/694 X |
| 4,150,812 | 4/1979 | Baron | 414/690 X |

*Primary Examiner*—Stephen G. Kunin
*Assistant Examiner*—Terrance L. Siemens
*Attorney, Agent, or Firm*—Ward, Lalos, Leeds, Keegan & Lett

[57] ABSTRACT

In a power shovel having a main frame, a front end assembly operatively connected to the main frame and a rope crowd system including a rope drum supported on the main frame, a motor supported on the main frame drivingly connected to the rope drum, a brake operatively connected to the rope drum and a rope wound on the drum and operatively connected to the front end assembly, a system for preventing the rope from becoming slack comprising apparatus responsive to an impending slack condition of the rope for actuating the drum brake thereby preventing continued pay out of the rope by the drum and apparatus responsive to motor torque in a pay-out direction for disengaging the motor from the rope drum, allowing the motor to continue to operate in the pay-out direction when said drum brake is actuated.

36 Claims, 20 Drawing Figures

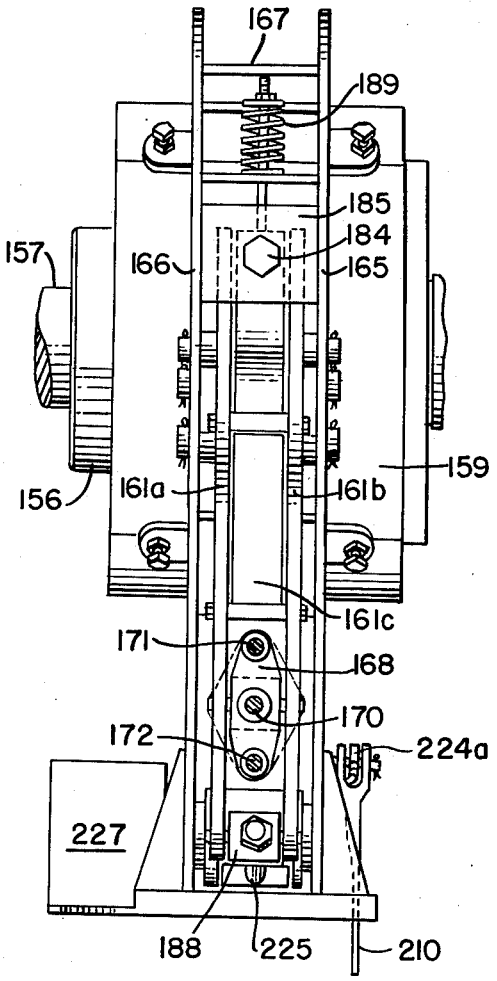
FIG. 15.
FIG. 16.
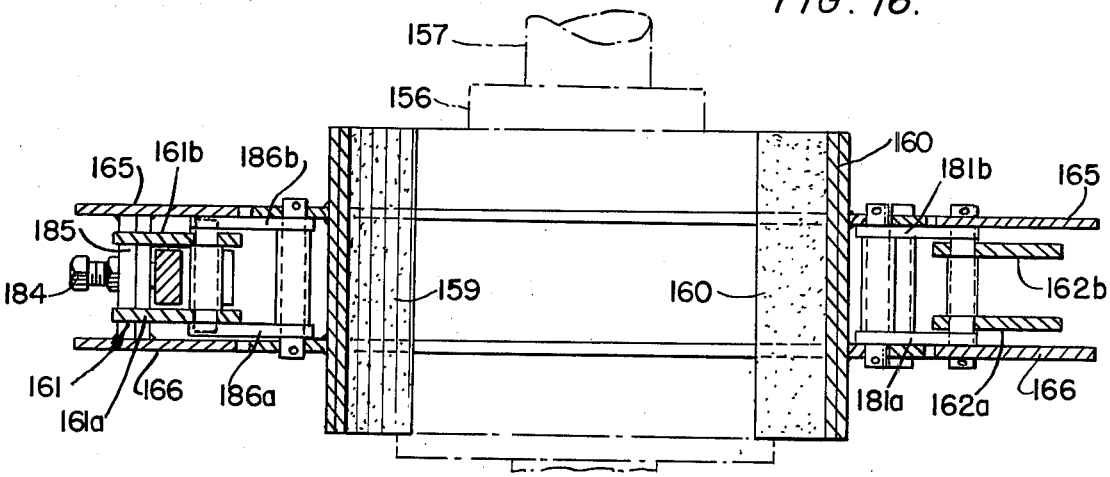

SLACK PREVENTION SYSTEM FOR A CROWD ROPE OF A POWER SHOVEL

This invention relates to power shovels and particularly to power shovels utilizing a rope crowd system. More specifically, this invention relates to a slack prevention system for a rope crowd system of a power shovel.

Rope crowd systems for conventional mining shovels generally consist of a rope drum mounted on the main frame of the shovel, one or more drive motors mounted on the main frame and operatively connected to the rope drum through a gear train arrangement, a brake for the drum, a set of stationary sheaves mounted on a gantry or other support structure located on the main frame, and a set of sheaves mounted on a mast pivotally connected to the main frame and linked to a front end assembly of the machine or mounted directly on the front end assembly of the machine, and a rope wound on the rope drum, reeved about the stationary and movable sets of sheaves and anchored on the gantry or other support structure. Examples of such type of rope crowd system are illustrated in U.S. Pat. Nos. 3,501,034, 3,648,863 and 4,044,903.

In the operation of the type of machine illustrated and described in the aforementioned patents, the actions of the rope crowd system and a hoist system are coordinated to cause the dipper mounted on the front end assembly to make a flat pass along ground level and be crowded into an embankment of material being excavated, hoisted to an elevated position so that it may be swung over a hauling vehicle or other repository and dumped, and lowered and retracted to a starting position adjacent the front end of the main frame to begin the next digging cycle. In such operation, whenever it is desired to crowd the dipper into the embankment of material being excavated, the crowd drive motor is operated in the payout direction permitting the front end assembly of the machine to be lowered at a controlled rate and causing the dipper to be moved forwardly. Whenever it is desired to retract the dipper, the crowd drive motor is operated to take in the crowd rope thus pivoting the front end assembly upwardly and rearwardly, and correspondingly moving the dipper rearwardly toward the main frame of the machine. Essentially, the rope crowd functions as a single-acting rope type drive.

In the use of the type of rope crowd system as described, it has been found that under certain conditions such as when the dipper is making a flat pass and the coordinated hoisting action stalls or when the operator is trying to ramp down into hard bottom, there is a tendency for the operator to misjudge the control of the crowd system and to pay out crowd rope too fast. Under such circumstances, the crowd rope becomes slack and often becomes fouled, requiring that the operation of the machine be interrupted to clear the rope fouling. The tendency for rope slackening and eventual fouling is compounded by the fact that the rope crowd system normally is located at a position on the main frame of the shovel which is disposed aft of the operator's station thus not within his normal view. The operator thus is not able to observe the condition of the crowd rope to enable him to take corrective action when the rope becomes slack. The condition further is compounded by the fact that when the crowd rope is being payed out, the rope drum is drivingly connected to the armature of the drive motor which has a large amount of kinetic energy when turning at a high speed. The torque developed by the rotating crowd drive armature is transmitted to the rope drum thus compounding the slackening of the rope and increasing its tendency to become fouled.

In view of the difficulty of controlling the pay out of crowd rope in power shovels equipped with rope crowd systems and the adverse effects of rope fouling in such systems due to excessive rope slack, it has been found to be highly desirable to provide a simple and automatic system for preventing rope slack in such systems.

Accordingly, it is the principal object of the present invention to provide a slack prevention system.

Another object of the present invention is to provide a slack prevention system for a crowd drive system of a power shovel.

A further object of the present invention is to provide an automatic slack prevention system of a rope crowd system of a power shovel.

A still further object of the present invention is to provide a slack prevention system for a rope crowd system of a power shovel which does not rely upon the observation or judgment of the operator of the machine.

Another object of the present invention is to provide a mechanical slack prevention system for a rope crowd system of a power shovel which operates automatically.

A further object of the present invention is to provide a slack prevention system for a rope crowd system of a power shovel which is simple in design, reliable in performance and comparatively economical to manufacture and service.

Other objects and advantages of the present invention will become more apparent to those persons having ordinary skill in the art to which the present invention pertains from the following description taken in conjunction with the accompanying drawings wherein:

FIG. 15 is a cross-sectional view taken along line 15—15 in FIG. 13;

FIG. 16 is a cross-sectional view taken along line 16—16 in FIG. 13;

Figure 1:
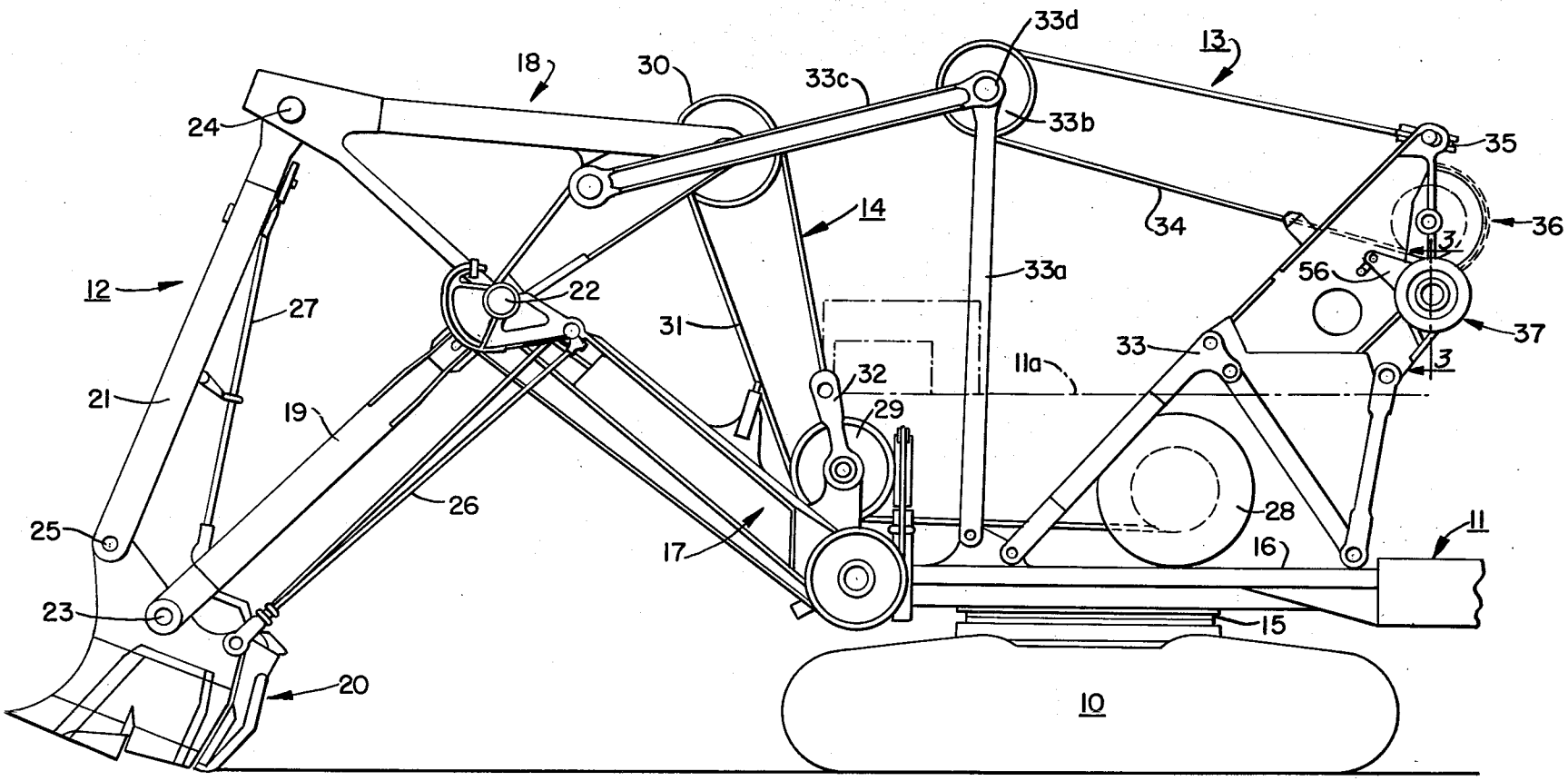
FIG. 1 is a side elevational view of a power shovel utilizing a rope crowd system incorporating an embodiment of the present invention.

Referring to the FIG. 1 of the drawings, there is illustrated a power shovel utilizing an embodiment of the present invention which generally includes a crawler unit 10, a main support unit 11 mounted on the crawler unit, a front end assembly 12 mounted on the front end of the main support unit, a crowd system 13 mounted on the main support unit and operatively connected to the front end assembly, a hoist system 14 mounted on the front end assembly, and appropriate controls mounted on the main support unit for operating the crowd and hoist systems. Crawler unit 10 consists of a lower frame supported on a pair of conventional crawler assemblies, and a conventional roller circle 15 mounted on the lower frame. Main support unit 11 consists of an upper frame 16 rotatably mounted on the roller circle and a housing 11*a* mounted on the upper frame, which encloses certain components of the housing structure, the swing and propulsion machinery and other auxiliary systems and equipment.

Front end assembly 12 generally includes a stiffleg 17, a hoist frame 18, a dipper handle 19, a dipper 20 and a hoist link 21. Stiffleg 17 consists of a structural member pivotally connected at its lower end to the front end of upper frame 16 and is provided at its upper end with a head shaft 22. Hoist frame 18 is pivotally mounted on head shaft 22. Handle 19 consists of a suitable structural member and is provided with upper and lower bifurcated ends. The upper bifurcated end is connected to the hoist frame by means of a pair of connecting pins. The lower bifurcated end of the handle is pivotally connected to the upper rear end of dipper 20 by means of a pair of axially aligned pins 23. The forwardly disposed head section of the hoist frame and the upper front end of dipper 20 are connected by hoist link 21. The upper end of the hoist link is connected to the bifurcated head section of the hoist frame by means of a connecting pin 24. The lower bifurcated end of the hoist link is connected to the dipper by means of a pair of axially aligned pins 25. It thus will be seen that hoist frame 18, handle 19, dipper 20 and hoist link 21 are pivotally connected together to provide a four-bar linkage with the link comprising the hoist frame being pivotally connected to the upper end of the stiffleg by means of head shaft 22.

To provide a substantially flat pass of the dipper when it is crowded into a bank of material being excavated or loaded, there is provided on the front end assembly a pitch control system 26, the construction and operation of which is fully described in U.S. Pat. Nos. 3,501,034 and 3,648,863. In addition, the front end assembly is provided with a pitch stop assembly 67, the construction and operation of which is fully described in U.S. Pat. No. 4,085,854.

Hoist system 14 generally includes a hoist drum 28, sheaves 29 and 30 and a hoist line 31. Hoist drum 28 is mounted on upper frame 16 of the machine and is driven by electric motors through a gear train also mounted on the upper frame. Sheave 29 is mounted on the lower end of stiffleg 17 in longitudinal alignment with hoist drum 28. Sheave 30 is mounted on an upper, rearward end of hoist frame 18. As illustrated in FIG. 1, hoist line 30 is wound on hoist drum 28, extends forwardly and around sheave 29, extends upwardly and around sheave 30 and extends downwardly and is connected to a bail 32 mounted on the mounting shaft of sheave 29. It further will be seen that by operating hoist drum 28 to pay out or take in hoist line 31, hoist frame 18, handle 19 and hoist link 21 will be caused to pivot about head shaft 22 to correspondingly hoist and lower the dipper.

Crowd system 13 consists of a gantry 33 mounted on upper frame 16 of the machine, a crowd drive assembly mounted on the upper end of the gantry above housing structure 11*a*, a mast 33*a* provided with sheaves 33*b*, a crowd link 33*c* and a crowd rope 34. Mast 33*a* consists of a structural member pivotally connected at its lower end to a bracket secured to upper frame 16, forwardly of the vertical center line of roller circle 15. The upper end of mast 33*a* is provided with a shaft 33*d* on which sheaves 33*b* are mounted. Crowd link 33*c* is pivotally connected at the ends thereof to hoist frame 18 and mounting shaft 33*d* at the upper end of mast 33*a* so that pivotal motion of mast 33*a* in a vertical plane will be transmitted by crowd link 33*c* to the front end assembly of the machine. Crowd rope 34 is operatively connected to the crowd drive assembly and extends forwardly and around sheaves 33*b*, and rearwardly where it is connected to a bail 35 mounted on the head portion of gantry 33.

Figure 2:
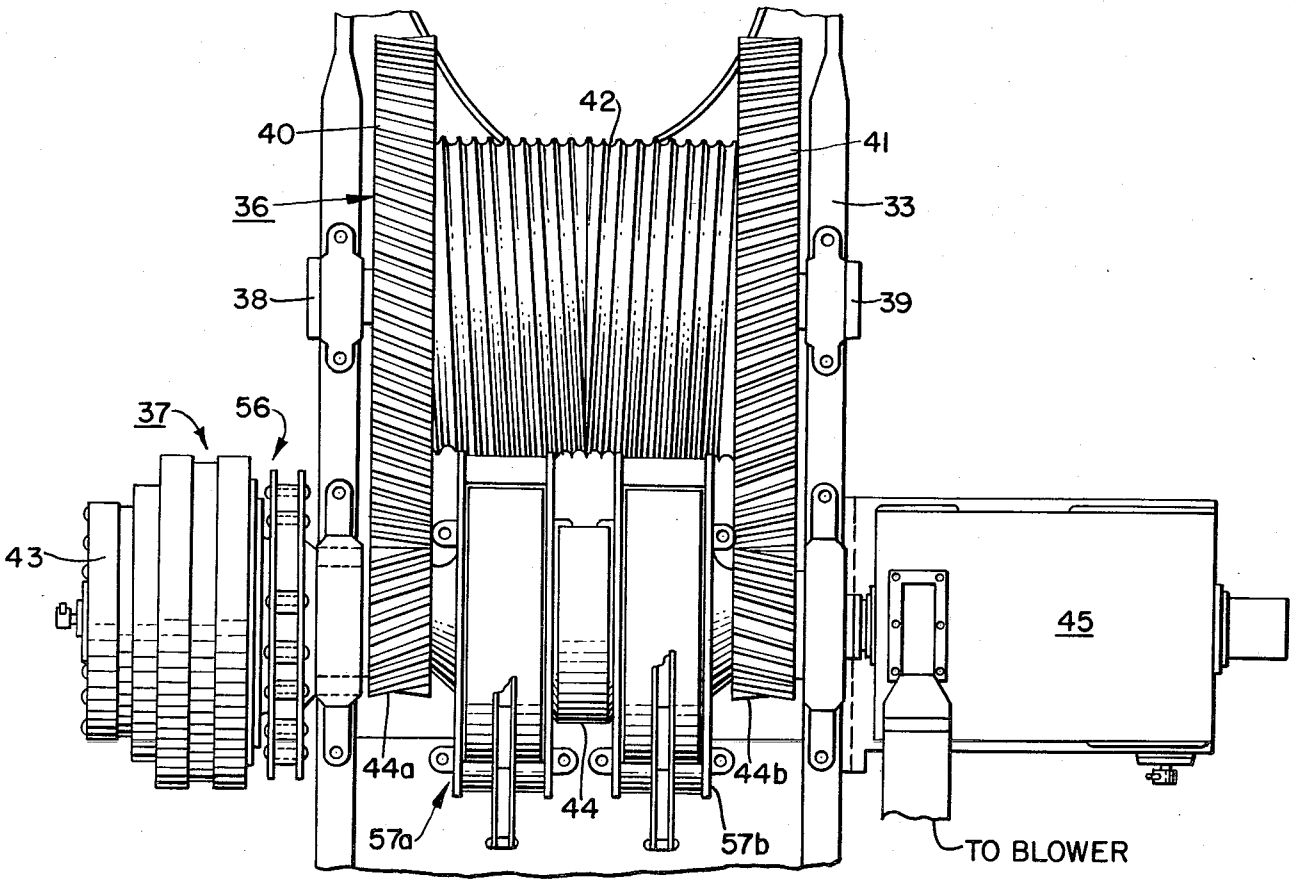
FIG. 2 is an enlarged rear elevational view of the rope drum and crowd drive assembly therefor of the shovel shown in FIG. 1.
Figure 3:
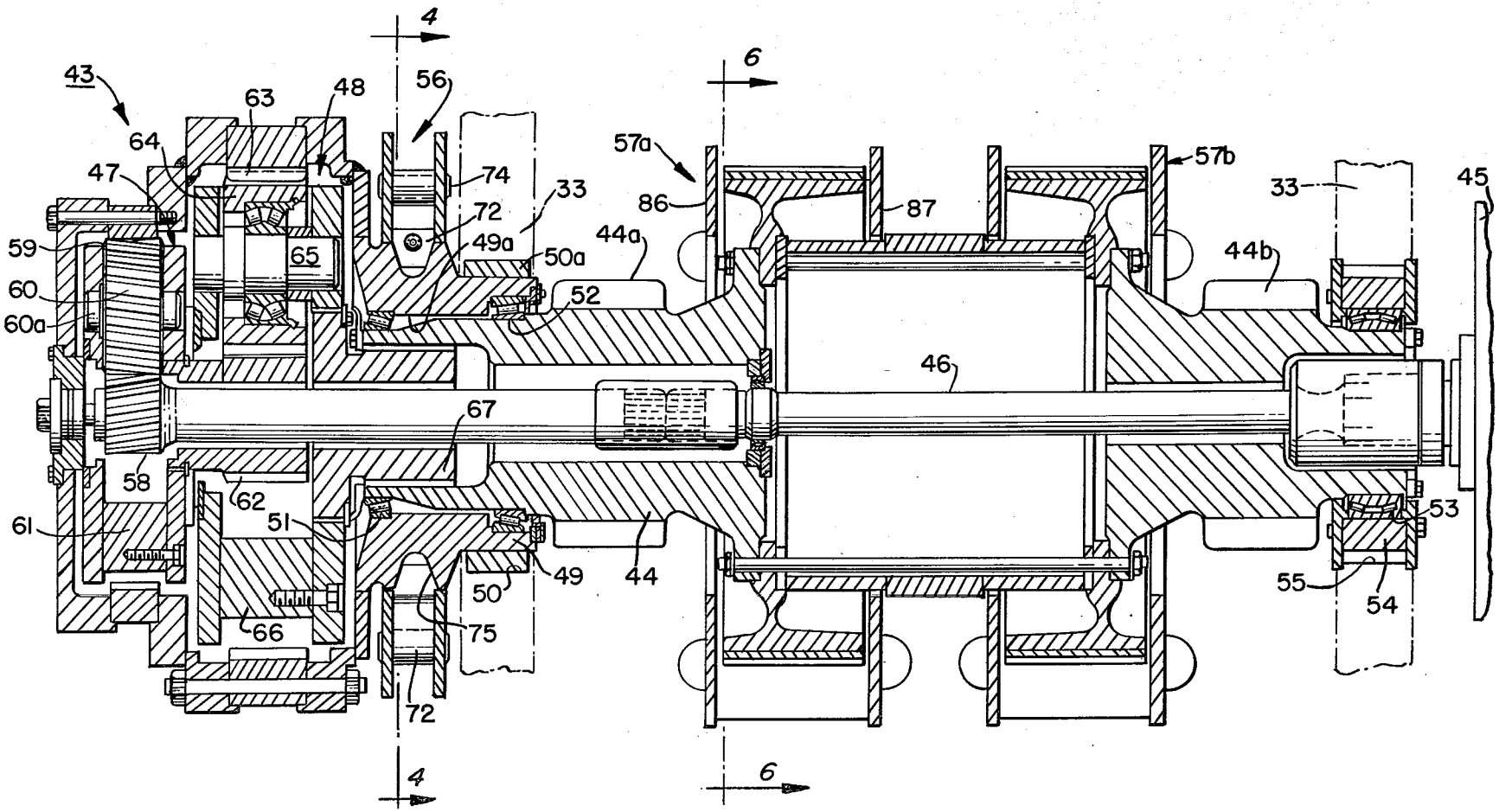
FIG. 3 is an enlarged cross-sectional view taken along line 3—3 in FIG. 1.

Referring to FIGS. 2 and 3, the crowd drive assembly consists of a rope drum 36 and a drive unit 37. The rope drum is trunnion mounted in a set of bearings 38 and 39 mounted in the upper, rear end of gantry 33. It is provided with a pair of transversely spaced gears 40 and 41 and an intermediate drum portion 42 provided with suitable guide grooves for winding crowd rope 34 thereon. Drum portion 42 is disposed substantially in alignment with mast 33*a* and mast sheaves 33*b* longitudinally of the power shovel.

Drive unit 37 generally consists of a gear case 43, a pinion shaft 44, a motor 45, a drive shaft 46 and planetary gear sets 47 and 48. Gear case 43 is formed with an annular portion 49 which is received within an opening 50 in gantry 33, provided with solid bearings 50*a*, for mounting the gear case on one side of the gantry. The axial opening in annular portion 49 is provided with a pair of bearings 51 and 52 for supporting one end of pinion shaft 44. Aligned axially with bearings 51 and 52 is a bearing 53 mounted in a bearing block 54 provided in an opening 55 in gantry 33, for supporting the other end of the pinion shaft. Pinion shaft 44 is provided with an axially disposed passageway and a pair of integrally formed helical pinions 44*a* and 44*b* which are adapted to mesh with helical bull gears 40 and 41 of crowd drum 36 when the drum is trunnion mounted in bearings 38 and 39 and pinion shaft 44 is journaled in bearings 51, 52 and 53.

Motor 45 may consist of either an electrical or a hydraulic motor and is rigidly mounted on gantry 33 on a side opposite from gear case 43. Drive shaft 46 is drivingly connected to the output shaft of motor 45 and extends through the entire length of the axial opening in the pinion shaft, into gear case 43. The free end of shaft 46 is centered in a bearing 43*a* mounted on the end wall of gear case 43.

Planetary gear set 47 consists of a sun gear 58, a ring gear 59 and a plurality of planetary gears 60. Sun gear 58 is formed integrally with the end of drive shaft 46. Ring gear 60 is formed as an outer wall section of gear case 43. Each of planetary gears 60 is provided with a shaft 60*a* mounted on a planetary gear carrier 61.

Planetary gear set 48 consists of a sun gear 62, a ring gear 63 and a plurality of planetary gears 64. Sun gear 62 is provided with an axial opening receiving drive shaft 46 therethrough, and is drivingly connected to planetary gear carrier 61 of gear set 47. Ring gear 63 is formed as a component of gear case 43. Each of planetary gears 64 is provided with a shaft 65 mounted in an annular carrier 66. Planetary gear carrier 66 is provided with an annular portion 67 which extends into an enlarged section of the opening in pinion shaft 44 and which receives drive shaft 46 therethrough. The outer end of annular carrier portion 67 is provided with external splines which engage a set of internal splines on the end of the pinion shaft to drivingly connect the planetary gear carrier of gear set 48 to the pinion shaft.

As best seen in FIGS. 1 and 2, the pinion shaft is mounted on the gantry adjacent the tangent point of rope 34 wound on drum 36. Thus, the proximity of the pinion gears to the tangent point of the rope will provide a resultant component of force which will function to counteract the force exerted on the drum by the rope, thereby reducing the load imposed on the drum bearings. Furthermore, the mounting of the gear train and motor at opposite ends of the pinion shaft, providing transversely spaced pinions for transmitting torque from the pinion shaft to the bull gears of the drum, and providing helical teeth on the pinion and bull gears of the assembly, further contribute to balancing the static and dynamic loads imposed on the drum bearings.

In the operation of the drive unit as described, whenever motor 45 is operated, drive will be transmitted through drive shaft 46, through planetary gear set 47, planetary gear set 48 and pinion shaft 44 to drum 36. Under such circumstances, the drive will be subjected to a first stage speed reduction by planetary gear set 47, a second stage speed reduction by planetary gear set 48 and a third stage reduction by the pinion gears and the gears on the rope drum. Rotation of gear case 43 in the pay out direction is restrained by a backstop mechanism 56 operatively interconnecting the gear case and the gantry. Furthermore, rotation of rope drum 36 may be restrained by assemblies 57*a* and 57*b*.

At the beginning of each digging cycle of the machine as described, the crowd system is operated to retract the front end assembly and the hoist system is operated to lower the dipper so that the dipper is positioned adjacent the lower end of the stiffleg. Suitable resilient pads are provided at the lower end of the stiffleg to prevent damage to the stiffleg by the dipper. To commence the operating cycle of the machine, the operator manipulates appropriate controls at the operator's station on the machine to permit the crowd rope to pay out. Under such conditions, the weight of the front end assembly will cause the stiffleg to pivot forwardly, crowding the dipper into the material being excavated or loaded. Simultaneously with the commencement of the crowding action of the dipper, appropriate controls are operated on the machine to effect limited hoisting motion of the dipper. This is accomplished by operating hoist drum 28 to take up hoist line 31. As the dipper is crowded into the bank of material being excavated or loaded, the combined crowding and hoisting action causes it to make a flat pass. At the same time, pitch control system 26 causes the pitch of the dipper to remain constant relative to the ground. At the end of the crowd phase of the cycle, the pitch control mechanism is released to cause the dipper to pitch upwardly and thus assure a full load of material in the dipper. The upward pitch of the dipper is restricted by pitch stop system 27 in a manner as described in the aforementioned patent relating to such system.

After the dipper has been pitched upwardly, controls for the crowd and hoist systems and swing machinery are operated to position the dipper above the dump body of a hauling vehicle or another suitable repository for the material, where the door of the dipper is tripped to cause the door to open and the material to be unloaded. The desired retracting motion of the front end assembly is effected by operating crowd motor 45 to rotate crowd drum 36 and take in crowd rope 34. Under such conditions, mast 33*a* will be caused to pivot rearwardly and such motion will be transmitted to the front end assembly 12 causing the stiffleg 17 to pivot upwardly.

As soon as the material has been dumped, the swing machinery can be operated to rotate the front end of the machine back to the embarkment, the crowd system can be operated to continue to retract the front end assembly and the hoist system can be operated to permit the dipper handle to swing downwardly at a controlled rate until it again is positioned at the lower end of the stiffleg, ready to begin another operating cycle.

The function of backstop mechanism 56 is to restrain the rotation of gear case 43 and correspondingly ring gears 59 and 63 of planetary gear sets 47 and 48 when it is desired to take in crowd rope so that drive will be transmitted from drive motor 45 to rope drum 36 as described, and to permit gear case 43 to rotate freely in the opposite direction when the motor torque is reversed so that torque developed by the kinetic energy in the armature of drive motor 45 will not be transmitted through the crowd drive assembly thus possibly compounding an undesirable slack condition of the crowd rope. It will be appreciated that by permitting the gear case to rotate, planetary gears 60 and 64 simply will rotate about their own axes and not react with ring gears 59 and 63 to cause planetary gear carrier 66 to rotate and thus transmit drive through pinion shaft 44 to the rope drum.

Figure 4:
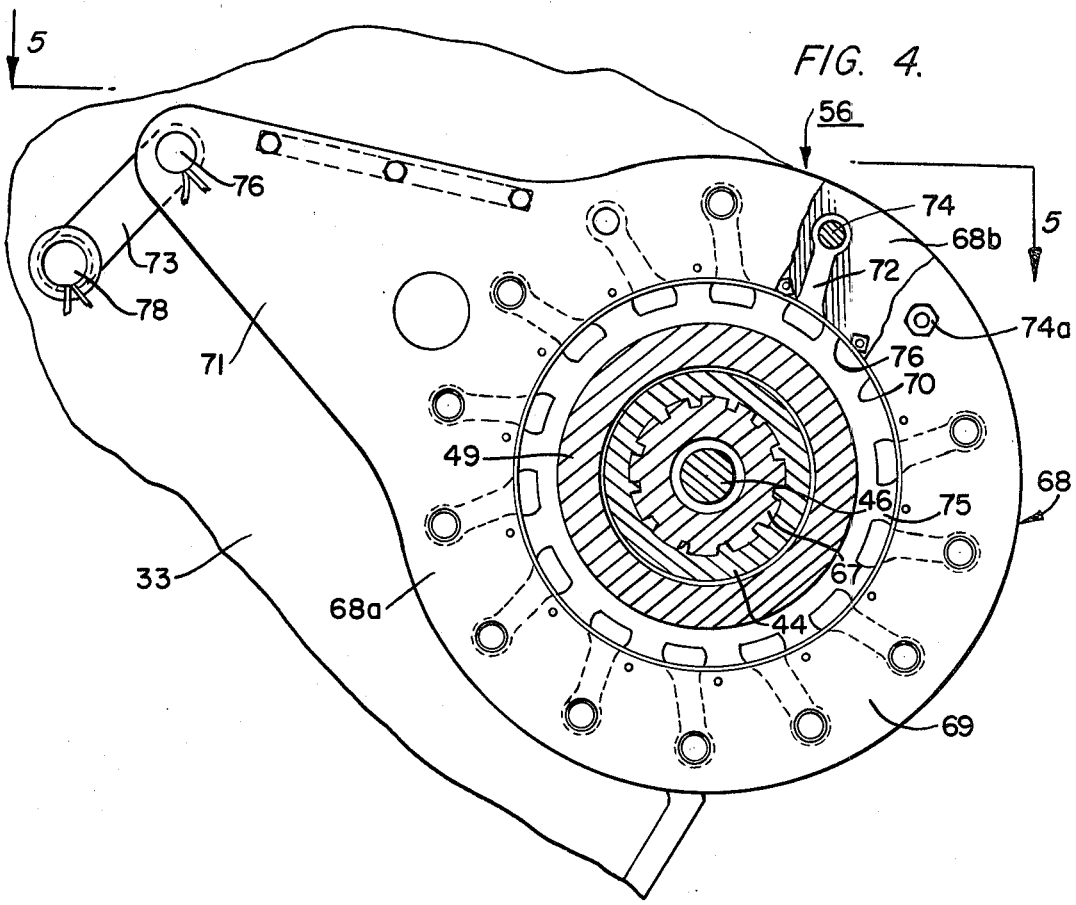
FIG. 4 is a cross-sectional view taken along line 4—4 in FIG. 3.
Figure 5:
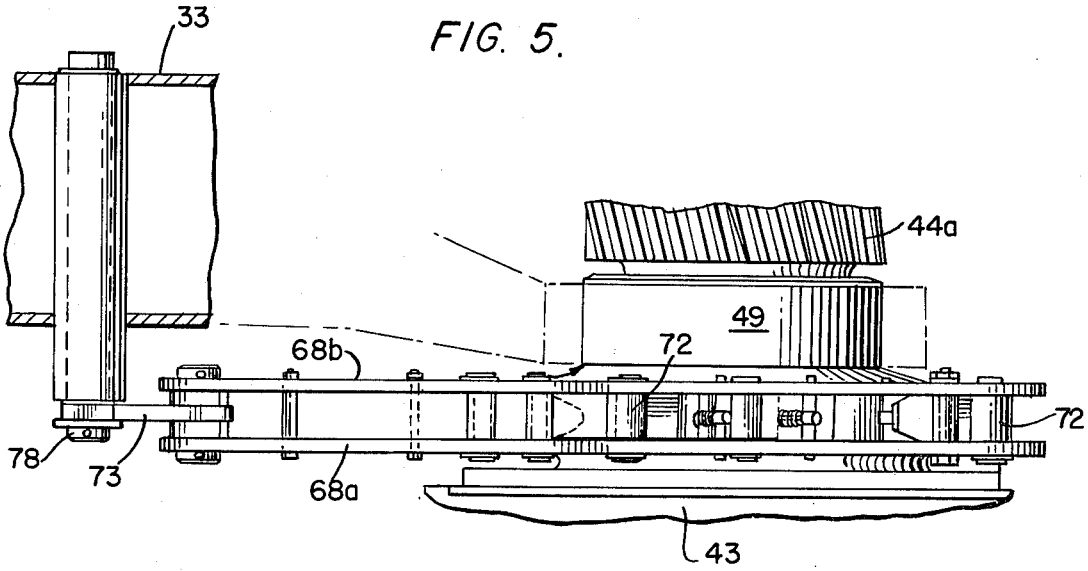
FIG. 5 is a cross-sectional view taken along line 5—5 in FIG. 4.

Referring to FIGS. 4 and 5, backstop mechanism 56 generally comprises a carrier member 68 having a main body portion 69 provided with a circular opening 70 for receiving reduced annular portion 49 of gear case 43 therethrough and an arm portion 71, a plurality of shoes 72 pivotally mounted on the main portion of the carrier member and circumferentially-spaced relative to and engageable with reduced annular section 49 of the gear case, and a restraining link 73 pivotally connecting the arm portion of the carrier member to gantry 33. Carrier member 68 consists of a pair of spaced, parallel plates 68*a* and 68*b* interconnected by a plurality of circumferentially-spaced pins 74. Shoes 72 are pivotally mounted on pins 74 having the free ends thereof running in a V-shaped groove 75 formed on the outer surface of annular gear case section 49. Each of shoes 72 is biased into engagement with V-shaped surface 75 by means of a spring element 76 mounted on the carrier member and acting on the free ends of the shoes. As best illustrated in FIG. 4, it will be noted that the spring biased shoes will frictionally engage V-shaped surface 75 and restrain the gear case when the gear case seeks to rotate in a counter-clockwise or rope take-in direction and will ride freely on the grooved surface in a clock-wise or rope pay out direction. Restraining link 73 is pivotally connected to arm portion 71 of the carrier member by means of a connecting pin 76. The opposite end of the link is connected to gantry 33 by means of a connecting pin 78.

The spacing of the shoes and the relative position of the restraining link are such that all of the shoes are equally loaded. It has been found that by utilizing a number of shoes spaced equidistantly and circumferentially, the force on the restraining link results in an unbalanced load between the backstop mechanism and the V-shaped groove in gear case section 49. It further has been found, however, that by omitting one of the shoes disposed parallel to the restraining link such as would be mounted on pin 74*a*, the load on the restraining link will be equal to the axial load along the length of each of the shoes, the result being that the load between the backstop and the V-groove in the gear case section 49 will be balanced and all of the shoes will be loaded equally.

Figure 6:
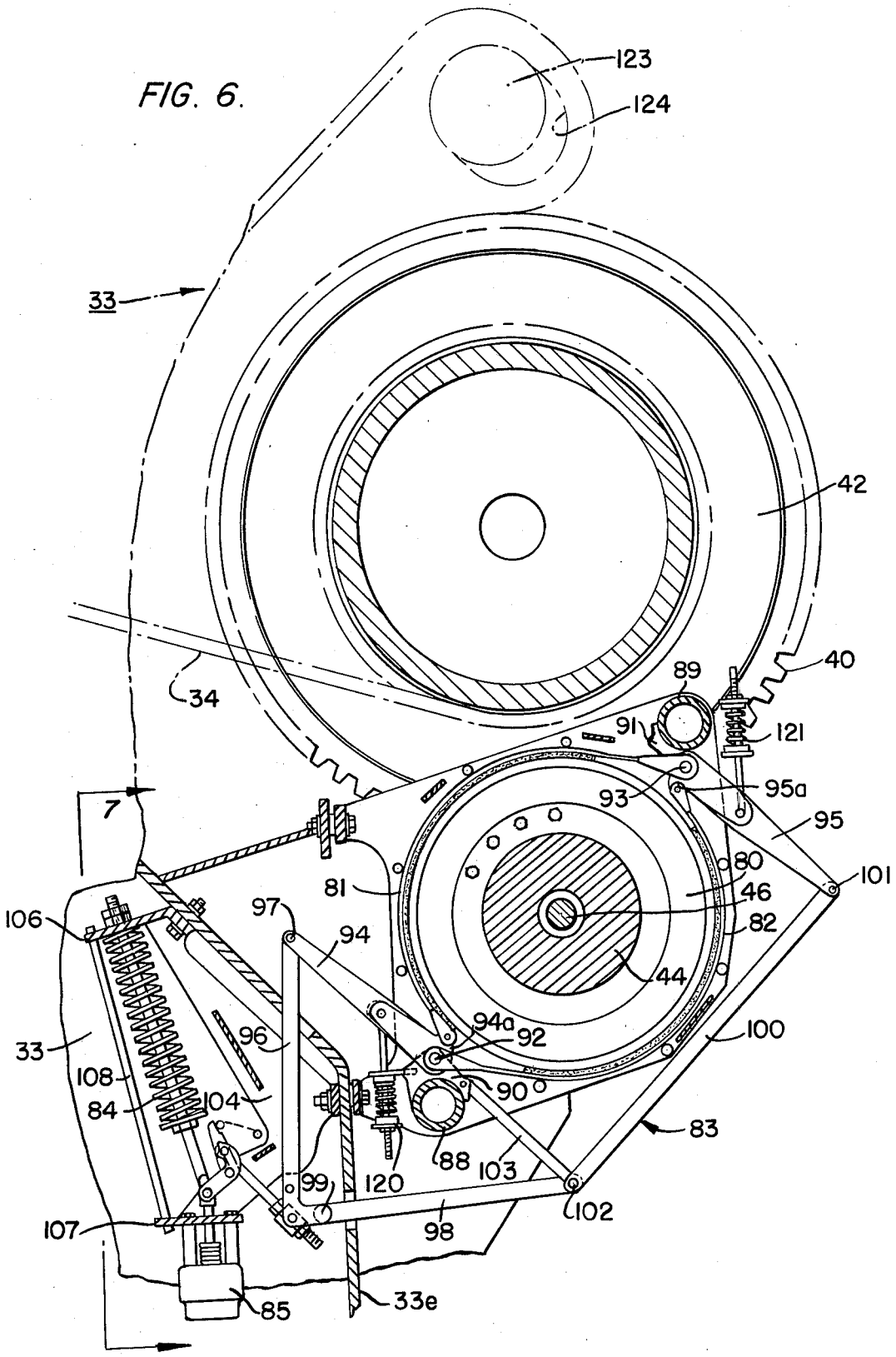
FIG. 6 is a cross-sectional view taken along line 6—6 in FIG. 3.

Brake assemblies 57*a* and 57*b* are substantially similar in construction and operation. Brake assembly 57*a* is best illustrated in FIGS. 3 and 6 through 8 and basically consists of a brake drum 80 mounted on pinion shaft 44, a set of brake bands 81 and 82 operatively engageable with the brake drum, a brake actuating linkage 83 supported on the gantry and operatively connected to the brake bands, a brake spring 84 mounted on the gantry and acting on linkage 83 to set the brake, and an air cylinder 85 mounted on the gantry and operative to act on linkage 83 against the action of brake spring 84 to release the brake. Flanking brake drum 80 and supported on gantry 33 is a set of mounting panels 86 and 87 interconnected at diametrically opposed sides by a set of tubular members 88 and 89. Rigidly secured to connecting members 88 and 89 is a set of mounting brackets 90 and 91 which serve to support linkage 83. Mounting brackets 90 and 91 are provided with pins 92 and 93 on which there are pivotally mounted brake band levers 94 and 95. As best shown in FIG. 6, one end of brake band 81 is anchored on mounting pin 93 and the opposite end thereof is connected to a pin provided on a crank arm portion 94*a* of lever 94. Similarly, one end of brake band 82 is anchored on mounting pin 92 and the opposite end thereof is connected to a mounting pin provided on a crank arm portion 95*a* of lever 95. It will be seen that by pivoting levers 94 and 95 in clockwise directions relative to FIG. 6, brake bands 81 and 82 will be urged into frictional engagement with brake drum 80 to provide a braking action.

Due to the wrap angle of the bands, the brake assembly is designed to hold less torque in the takeup direction than in the payout direction. The application of equal force to levers 94 and 95 is effected by an L-shaped link 96 pivotally connected at an upper end to lever 94 as at 97, a link 98 pivotally connected at one end thereof to the foot portion of link 96 as at 99, a link 100 pivotally connected at the ends thereof to lever 95 and link 98 as at 101 and 102 and a support link 103 pivotally connected to mounting bracket 90 and pivotally connected at the other end thereof to links 98 and 100 as at 102. Secured to gantry section 33*e* is a pair of support plate members 104 and 105 supporting a pair of upper and lower mounting brackets 106 and 107 maintained in spaced relation by a spacer rod 108. Mounted at a lower end of support plates 104 and 105 is a mounting pin 109 on which there is pivotally mounted a set of hook-shaped levers 110*a* and 110*b*. A pair of levers 111*a* and 111*b* also are pivotally mounted on mounting pin 109 which are provided with an abutment pin 112 which is adapted to be engaged by the hook portions of levers 110*a* and 110*b*.

Figure 8:
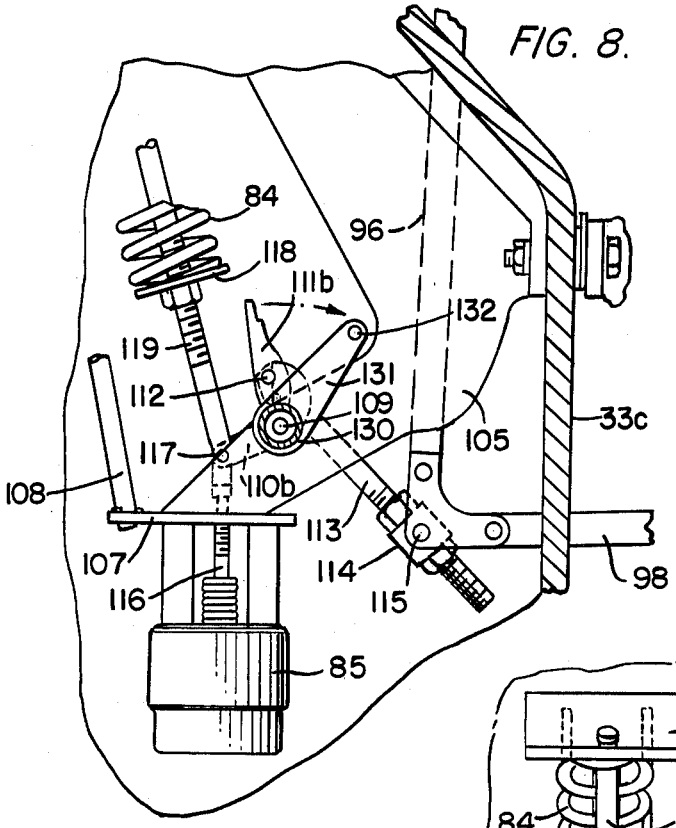
FIG. 8 is a cross-sectional view taken along line 8—8 in FIG. 7.

Pivotally connected to pin 112 is a rod member 113 provided with a collar 114 pivotally connected to the base portion of link 96 as at 115. As best shown in FIG. 8, collar member 114 is disposed on a threaded end portion of rod 113 and is prevented from becoming displaced along the length of the rod by means of a set of nuts threaded on the end of the rod. It further will be appreciated that by adjusting the nuts on the threaded portion of the rod, the location of the collar along the length of the rod may be displaced for adjustment purposes.

Air cylinder 85 is mounted on mounting bracket 107 and is provided with an actuating rod 116 pivotally connected to the lower ends of hook-shaped levers 110*a* and 110*b* by means of a connecting pin 117. Brake spring 85 is seated on upper mounting bracket 106 and exerts a downward force on an end plate 118 bearing against a nut threded on the lower end of a center rod 119. The lower end of center rod 119 is pivotally connected to pin 117 so that the forces exerted by spring 84 and air cylinder 35 act in opposite directions to pivot hook-shaped levers 110*a* and 110*b* in different directions.

Under normal conditions, with the brake spring extended as illustrated in FIG. 6, hook-shaped levers 110*a* and 110*b* will be pivoted in a counter-clockwise direction to a position as illustrated in the drawings to cause actuating rod 113 to move upwardly generally along the line of its axis. Such motion will be transmitted through linkage 83 to levers 94 and 95 causing them to pivot in clock-wise directions and set the brake. Whenever it is desired to release the brake as when it is desired to either pay out or take in crowd rope, air cylinder 85 is actuated to cause hook-shaped levers 110*a* and 110*b* to pivot in a clock-wise direction thereby removing the upward force applied to actuating rod 113. Under such circumstances, levers 94 and 95 are caused to pivot in counter-clockwise directions by the action of a set of release springs 120 and 121. Again, when air cylinder 85 is deactivated, hook-shaped levers 110*a* and 110*b* will be caused to rotate clock-wise by brake spring 84, into the positions as shown in FIGS. 6 and 8 to set the brake again.

During the crowding phase of a normal digging cycle, brake assemblies 57*a* and 57*b* are in the released condition to permit the rope drum to freely pay out crowd rope. Whenever the crowd rope becomes slack for the various reasons as previously mentioned, unless the operator is aware of the circumstances, the brake will remain in the released condition and the drum will be permitted to continue to pay out crowd rope thus aggravating the slack condition of the rope and increasing the chances of the rope fouling. In the embodiment of the invention shown in FIGS. 1 through 9 of the drawings, such condition automatically is avoided by a set of slack prevention systems mounted on the gantry and cooperable with brake assemblies 57*a* and 57*b* for resetting the brake whenever a slack condition in the crowd rope occurs.

Figure 7:
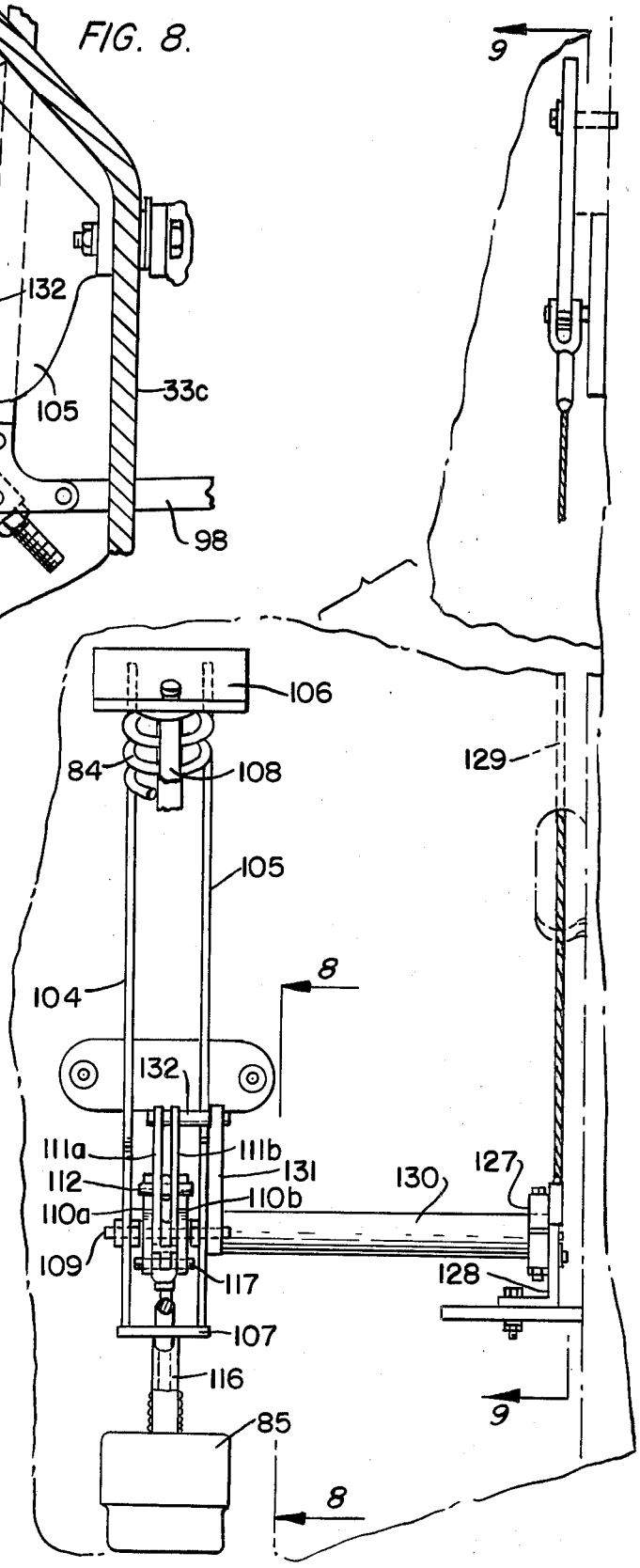
FIG. 7 is an enlarged cross-sectional view taken along line 7—7 in FIG. 6.
Figure 9:
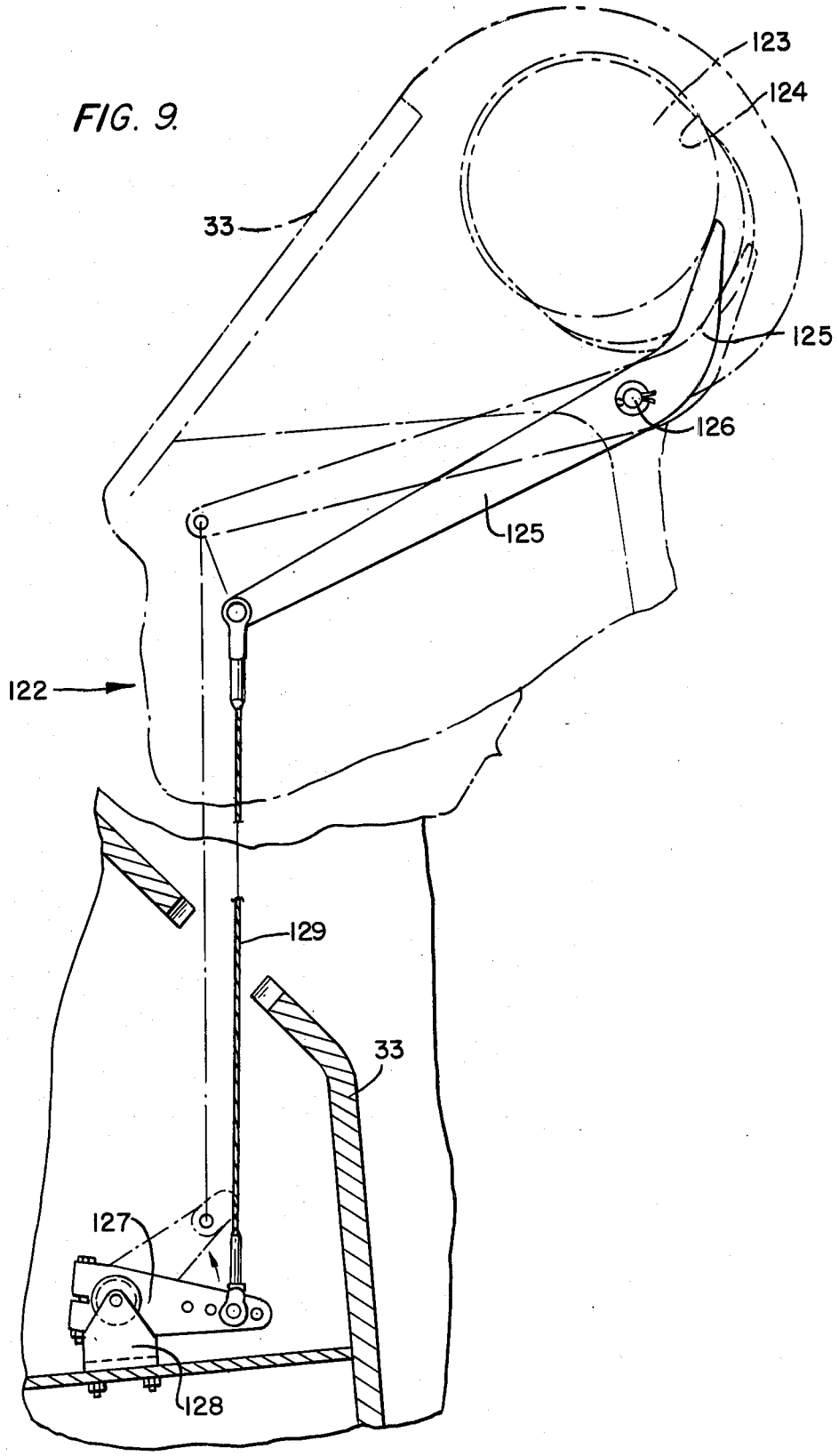
FIG. 9 is a cross-sectional view taken along line 9—9 in FIG. 7.

Referring to FIGS. 7 and 9, there is illustrated in slack prevention system 122 which is operatively connected to brake assembly 57*a* and functions automatically to set the brake whenever the crowd rope becomes slack. The system is adapted to sense a slack condition of the crowd rope by sensing the position of the crowd rope bail 35. As shown in FIG. 9, crowd rope bail 35 is provided with a set of laterally projecting trunnions 123 which are received within a pair of slots 124 provided at the head of the gantry. The slots have a substantially oblong configuration, inclining downwardly and rearwardly. Whenever crowd rope 34 is taut, the rope force exerted on the bail will cause the bail trunnions to ride upwardly in slots 124 and assume positions at the upper ends of the slots. However, whenever the rope force abates as when the rope becomes slack, the bail trunnions will be caused to slide to the lower ends of the slots.

Slack prevention system 122 functions to sense the positioning of the bail trunnions at the lower ends of slots 124 and correspondingly to actuate the brake assembly. To accomplish such results, the system is provided with a lever 125 pivotally mounted on a pin 126 disposed at the head of the gantry below slot 124, having an arm portion 125*a* engageable by a bail trunnion to pivot the lever when the trunnion moves to the lower end of the slot, a lever 127 mounted on a bracket 128 for pivotal movement about an axis disposed in alignment with mounting pin 109, a wire rope 129 interconnecting levers 125 and 127 for transmitting the pivotal motion of lever 25 to lever 127, a tubular member 130 mounted at one end on lever 127 and disposed coaxially relative to the pivot axis of lever 127, a radially disposed arm 131 mounted on the end of tubular member 130 and an abutment pin 132 mounted on the end of arm member 131 and engageable with levers 111*a* and 111*b*.

In the operation of the slack prevention system, whenever the crowd rope begins to become slack and the bail is permitted to fall under its own weight to the lower ends of slots 124, trunnion 123 will engage lever 125 to cause it to rotate in a clockwise direction relative to FIG. 9. Such pivotal movement will be transmitted through wire rope 129 to lever 127 causing arm member 131 to pivot. Such pivotal movement of arm member 131 will cause abutment pin 132 to engage levers 111*a* and 111*b* and cause them to pivot in a counter-clockwise direction, moving actuating rod 113 upwardly thereby causing linkage 83 to set the brake. It will be appreciated that regardless of the condition of air cylinder 85 which may be activated to counteract the normal brake force of brake spring 84, the slack prevention system is operable to set the brake through linkage 83 whenever bail 35 falls to its lower position due to a slack condition of the rope.

Although backstop mechanism 56 and slack prevention assembly 122 operate independently responsive to different conditions, their functions both contribute to prevent rope slack. During the crowd phase of a digging cycle, slack prevention system 127 will operate automatically to apply the brake drum whenever the crowd rope becomes slack. Complimentary to such slack prevention action, the backstop mechanism functions to disengage the drive motor from the crowd drum thereby eliminating the transmission of torque to the rope drum developed by the kinetic energy of the rotating armature of the motor which otherwise would have the effect of compounding the slack condition of the crowd rope and increasing the braking action required of the brake assembly.

Figure 10:
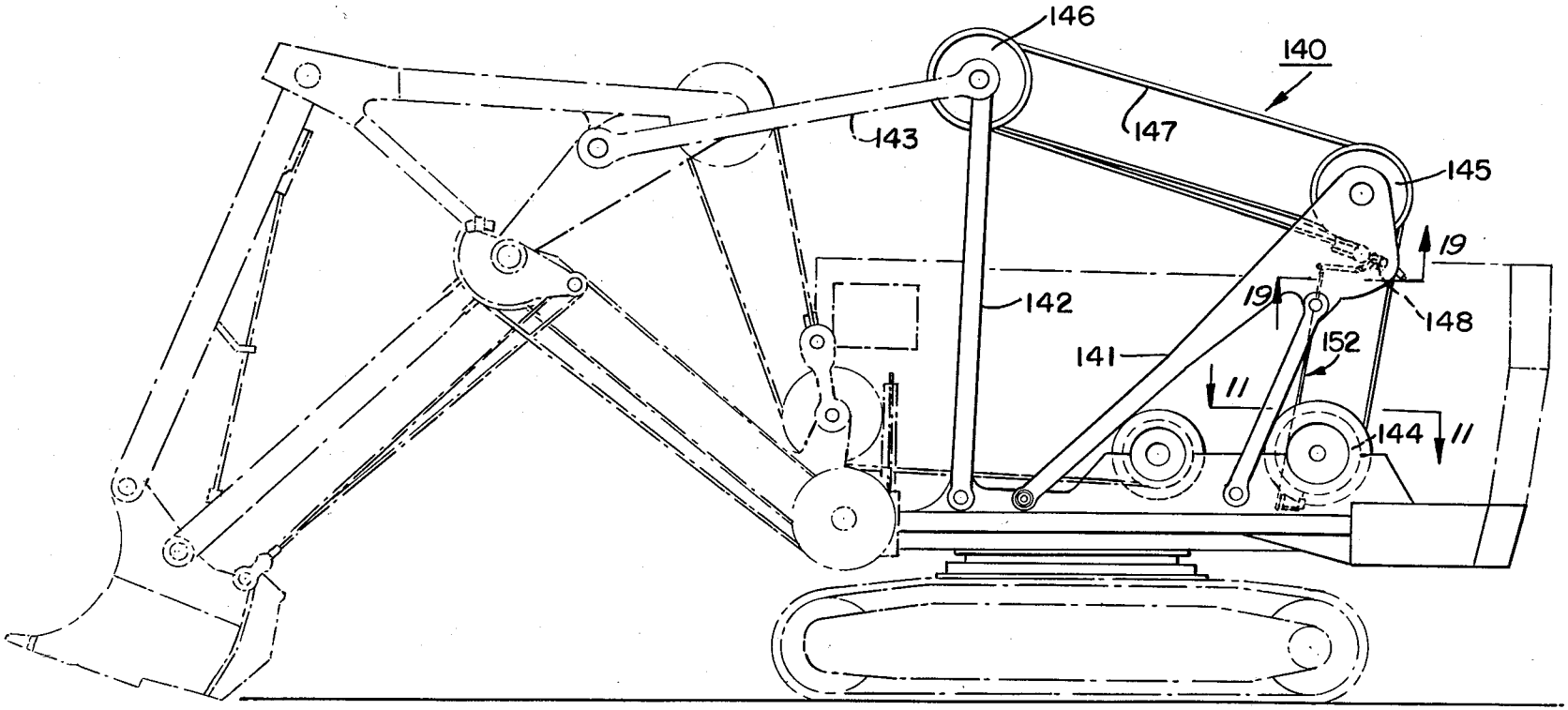
FIG. 10 is a side elevational view of a power shovel utilizing a rope crowd system incorporating another embodiment of the present invention.
Figure 11:
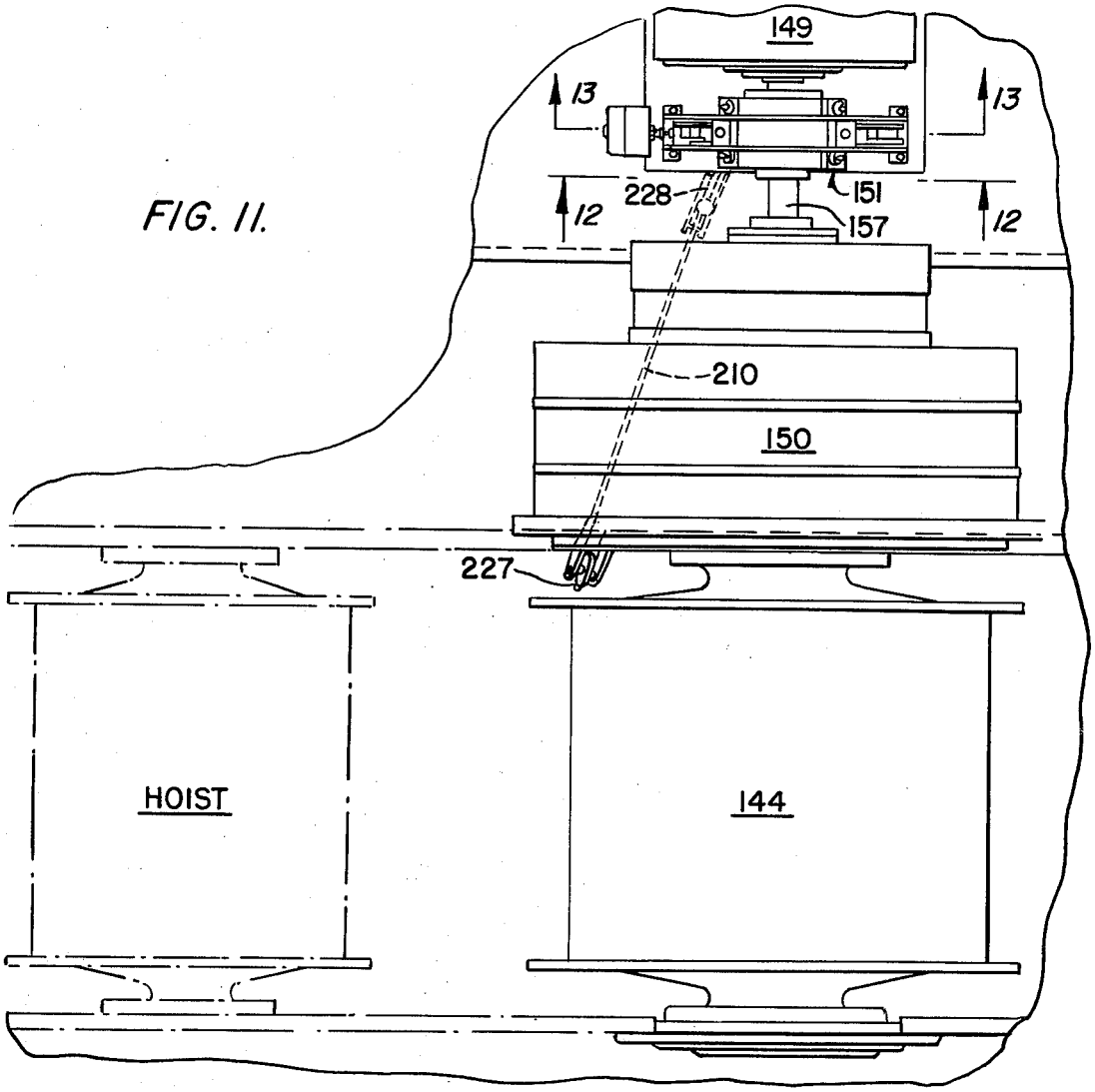
FIG. 11 is an enlarged cross-sectional view taken along line 11—11 in FIG. 10.
Figure 12:
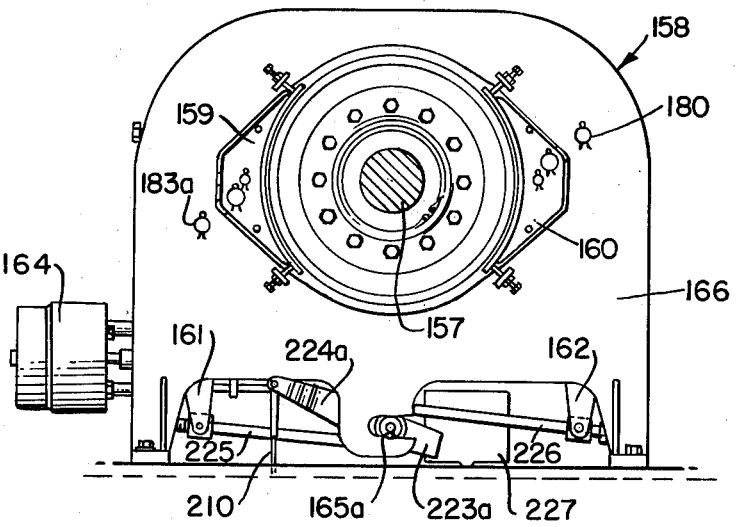
FIG. 12 is an enlarged cross-sectional view taken along line 12—12 in FIG. 11.

FIG. 10 illustrates a power shovel similar in construction and operation to the power shovel shown in FIG. 1 but utilizing a modified crowd system embodying another embodiment of the invention. Generally, the crowd system includes a gantry 141 mounted on the deck of the main frame of the machine, a mast 142 pivotally connected to the deck of the main frame, a crowd link 143 pivotally connected at the rearward end thereof to the upper end of the mast and pivotally connected at the forward end thereof to the front end assembly of the machine, a rope drum 144 mounted on the deck of the machine, a set of sheaves 145 mounted at the head of the gantry, a set of sheaves 146 mounted on the upper end of the mast and a rope wound on drum 144 reeved about sheaves 145 and 146 and dead-ended at a bail 146 supported at the upper end of the gantry. As best shown in FIG. 11, the system further includes a drive motor 149 drivingly connected to rope drum 144 through a gear train set 150 and a brake assembly 151. In addition, the system includes a slack prevention system 152 which is operative to set brake assembly 151 in response to a slack condition of crowd rope 147.

Figure 17:
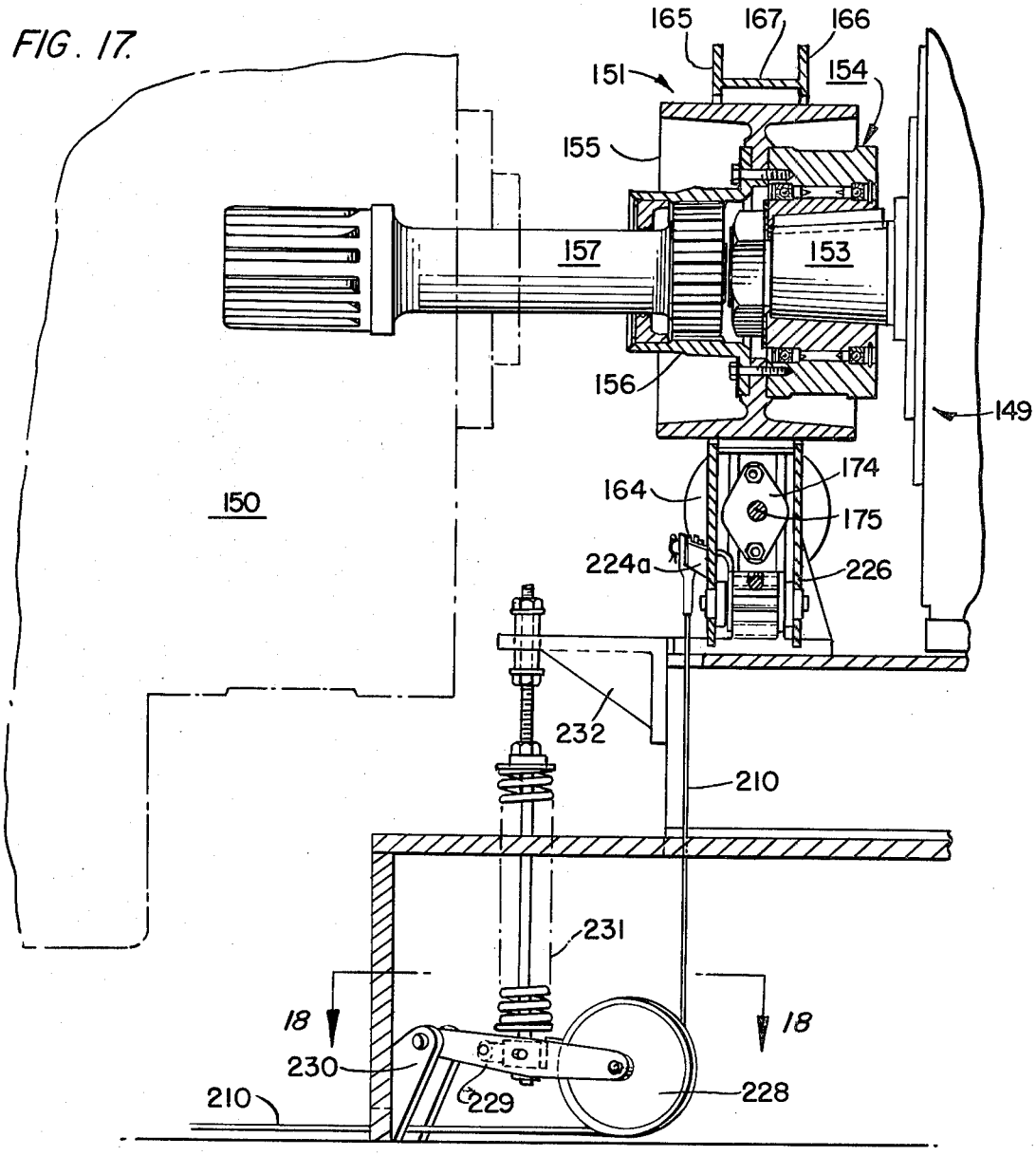
FIG. 17 is an enlarged cross-sectional view taken along line 17—17 in FIG. 13.

Referring to FIG. 17, drive motor 149 is provided with an output shaft 153 on which there is mounted an over-running clutch 154. A brake drum 155 of brake assembly 151 is mounted on the output component of over-running clutch 154 along with and adaptor 156 which is splined to an input shaft 157 of gear set assembly 150. Clutch 154 is of a type which will transmit drive in one direction but not in an opposite direction. In particular, in the present application, clutch 154 functions to produce the same result as the backstop mechanism described in connection with the embodiment of the invention illustrated in FIGS. 1 through 10, i.e., to transmit drive to rope drum 144 for rotating the drum in a rope takeup direction and to disengage the drive when the motor torque is in a rope pay-out direction.

Figure 13:
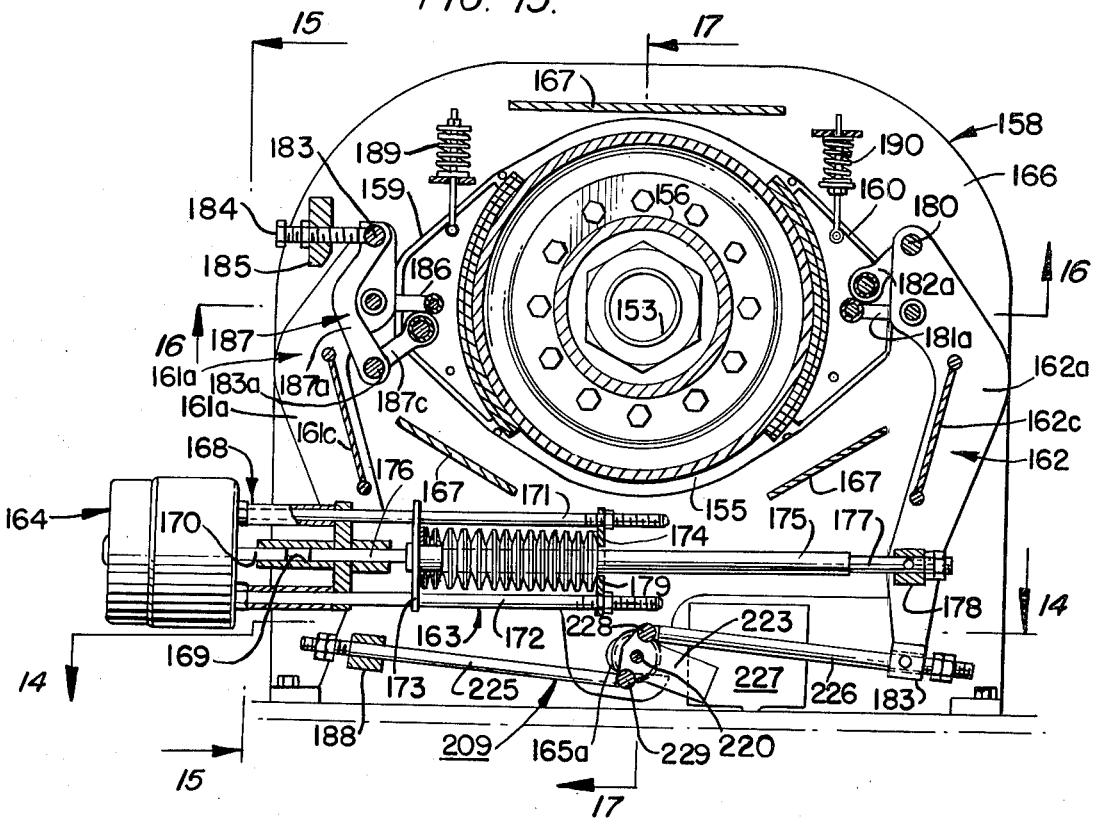
FIG. 13 is an enlarged cross-sectional view taken along line 13—13 in FIG. 11.

Brake assembly 151 is best illustrated in FIGS. 13 through 18. Generally, it consists of a frame 158 mounted on the deck of the main frame of the machine, a set of brake shoes 159 and 160 operatively engageable with opposite sides of brake drum 155, a pair of brake actuating levers 161 and 162, an actuating mechanism 163 operatively connected to actuating levers 161 and 162 and an air cylinder 164. Frame assembly 158 consists of a set of support panels 165 and 166 provided with cross-piece members 167 and a set of aligned openings in which brake drum 155 and brake shoes 159 and 160 are disposed. Referring to FIG. 13, actuating mechanism 163 includes a base member 168 rigidly secured to the front end of air cylinder 164 and pivotally connected through a set of trunnions to the lower end of brake actuating lever 161. The base member further is provided with an axial opening 169 therethrough which is adapted to receive an extendable rod 170 of air cylinder 164 when the cylinder is activated, and a set of support rods 171 and 172 disposed substantially parallel to axial opening 169. Mounted on support rods 171 and 172 is a pair of end plates 173 and 174. An actuating rod 175 is rigidly secured to end plate 73 and extends through an opening in end plate 174. Actuating rod 175 has a reduced portion 176 disposed at one end thereof adjacent end plate 173 which extends into axial opening 169 of base member 168 and is engageable by rod 170 when it is extended upon activating cylinder 164. It further is provided with a reduced end portion 177 at the opposite end thereof which extends through a collar member 178 which is pivotally connected to brake actuating lever 162 through a trunnion mounting. The outer end of reduced rod portion 177 is threaded and provided with a set of nuts which engage collar member 178 to prevent end portion 177 from being withdrawn from collar member 178. Similarly, the free ends of support rods 171 and 172 are threaded and provided with nuts which form abutments for end plate 174. End plates 173 and 174 are biased apart by a plurality of Bellville springs 179 disposed on actuating rod 175 between end plates 173 and 174.

Brake actuating lever 162 consists of a pair of side plate members 162*a* and 162*b* interconnected by a cross-piece member 162*c*. The upper end of lever 162 is pivotally mounted on a pin 180 supported on support panels 165 and 166. The upper end of the lever is operatively connected to brake shoe 160 by live links 181*a* and 181*b* pivotally connected at the ends thereof to the brake shoe and actuating lever 162, and disposed substantially radially relative to brake drum 155, the dead links 182*a* and 182*b* pivotally connected at the ends thereof to mounting pin 180 and the brake shoe, and disposed at an acute angle relative to live links 181*a* and 181*b*. The lower end of actuating lever 162 is provided with a collar member 183 trunnion mounted on the lower ends of side plate members 162*a* and 162*b*.

Brake actuating lever 161 consists of a pair of side plate members 161*a* and 161*b* rigidly connected together by means of a cross-piece member 161*c*. The upper ends of side plate members 161*a* and 161*b* are provided with a mounting pin 183 which is adapted to engage an inner end of a bolt 184 threaded through a cross-piece member 185 supported on support panels 165 and 166. As will later be described, the end of bolt 184 provides an abutment for mounting pin 183 and thus serves as a fulcrum for lever 161. Lever 161 is operatively connected to brake shoe 159 by means of a set of live links 186*a* and 186*b*, and a dead linkage consisting of a guide link 187*a* connected to pins 183 and 183*a* and links 187*b* and 187*c* connected to pin 183*a* and brake shoe 159. Pin 183*a* is carried in support panels 165 and 166. Live links 186*a* and 186*b* are disposed substantially radially relative to the brake drum, in alignment with live links 181*a* and 181*b*. Dead links 187*b* and 187*c* are disposed at an acute angle relative to live links 186*a* and 186*b* and substantially parallel to dead links 182*a* and 182*b*. Due to the slope of the dead links interconnecting brake actuating levers 161 and 162 with brake shoes 159 and 160, the torque capability of the brake assembly in the take-up direction of the rope drum is less than the capability in the pay out direction of rotation of the rope drum. The lower end of brake actuating lever 161 also is provided with a collar member 188 which is trunnion mounted on side plate members 161*a* and 161*b*.

Under normal conditions, the biasing force of Bellville springs 179 acts on end plates 173 and 174 to cause the support rods 171 and 172 and actuating rod 175 to be moved together. Such force is transmitted through base member 168 and collar member 178 to pivot brake actuating levers 161 and 162 toward each other about pins 180 and 183 and cause the brake shoes to frictionally engage the brake drum and provide a braking action. Whenever it is desired to release the brake, air cylinder 164 is actuated to extend rod 170 of the cylinder. Under such conditions, rod 170 will engage reduced rod section 176 to compress springs 179, causing support rods 171 and 172 and actuating rod 175 to move apart, correspondingly permitting levers 161 and 162 to pivot outwardly to release the brake. A set of springs 189 and 190 supported on frame 158 and acting on brake shoes 158 and 160 functions to displace the brake shoes relative to the brake drum to eliminate any drag on the drum when the brake is released. Whenever it is desired to re-apply the brake, air cylinder 164 is deactivated, causing springs 179 to move support rods 171 and 172 and actuating rod 175 together.

Figure 19:
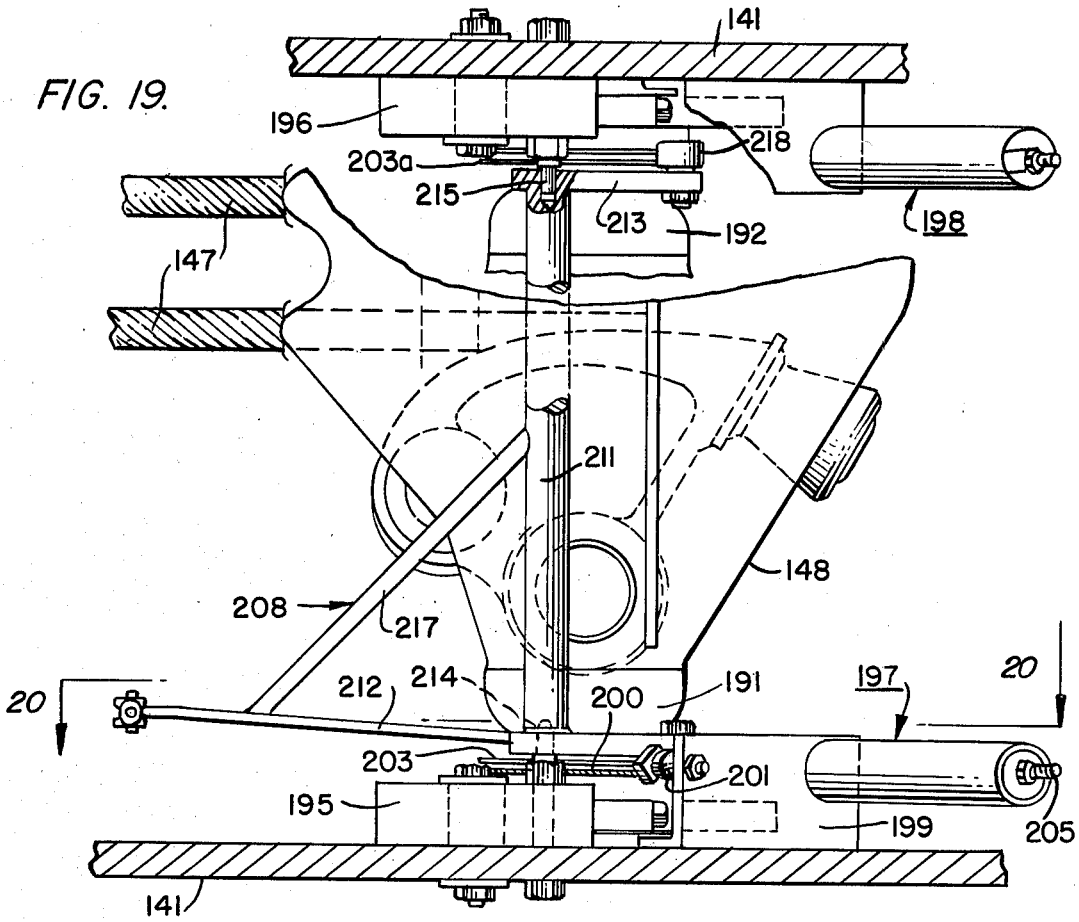
FIG. 19 is an enlarged cross-sectional view taken along line 19—19 in FIG. 10.
Figure 20:
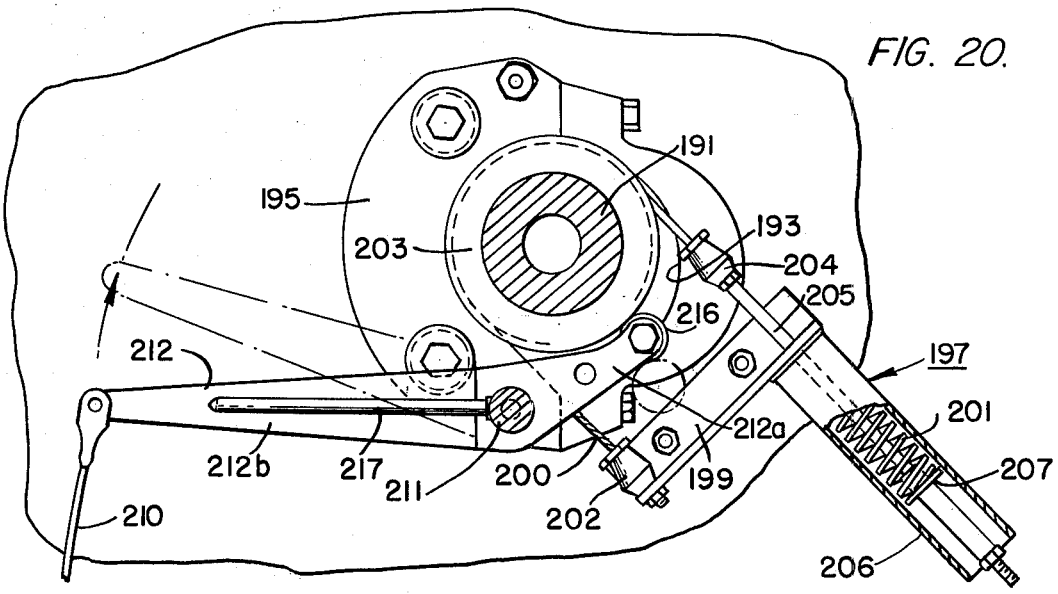
FIG. 20 is a cross-sectional view taken along line 20—20 in FIG. 19.

As best illustrated in FIGS. 19 and 20, bail 148 which serves to anchor the free end of crowd rope 147 to the upper end of the gantry adjacent sheaves 145, is provided with trunnions 191 and 192 which are supported in a set of transversely aligned slots 193 and 194 formed in mounting brackets 195 and 196 secured to the upper section of gantry 141. Slots 193 and 194 are inclined relative to the horizontal and extend downwardly and rearwardly. Trunnions 191 and 192 are biased in a lower position in such slots by a pair of biasing mechanisms 197 and 198 which are substantially identical in construction and function. Referring to FIG. 20, it will be seen that biasing mechanism 197 consists of a base member 199, a wire rope 200 and a spring 201. Base member 199 is bolted to the gantry structure adjacent the lower end of slot 193. Wire rope 200 is secured to a socket 202 secured to one end of base member 199, extends around an annular groove provided on an annular member 203, mounted on trunnion 191 and is secured to a socket 204 secured to a rod 205 extending through an opening in the opposite end of base member 199 into a cylindrical spring housing 206. Spring 201 is interposed between a lower side of base member 191 and an end plate 207 mounted on rod 205. It will be appreciated that spring 201 will provide a biasing force against end plate 207 to draw the wire rope around annular member 203, biasing trunnion 191 and correspondingly the bail to the lower position in slot 204.

Slack prevention system 152 generally consists of a lever mechanism 208 mounted on the upper end of the gantry and operatively connected to bail 148 for sensing the disposition of the bail at the lower end of slots 193 and 194, a brake actuating mechanism 209 mounted on the deck and operatively connected to the brake assembly and a wire rope 210 operatively interconnecting lever mechanism 208 and actuating mechanism 209. Lever mechanism 208 consists of a support rod 211 and a pair of levers 212 and 213. Support rod 211 is pivotally mounted on a set of transversely aligned mounting pins 214 and 215 mounted on mounting brackets 195 and 196 below bail 148 and adjacent the lower front ends of slots 193 and 194. Lever 212 is rigidly secured to support rod 211 adjacent mounting pin 214 and is provided with arm portions 212*a* and 212*b*. The free end of arm portion 212*a* is provided with a roller 216 which is adapted to engage the lower periphery of annular member 203. Arm portion 212*b* is connected at the end thereof to the upper end of wire rope 210. Arm portion 212*b* is reinforced by a strut 217 interconnecting the arm portion and a center portion of support rod 211. Lever 213 is rigidly connected to the opposite end of support rod 211 and is provided with a roller 218 which is adapted to engage the lower periphery of annular member 203*a* mounted on trunnion 192. Rollers 216 and 218 are axially aligned and are adapted to be engaged by annular members 203 and 203*a* when the bail fails to a lower position in slots 193 and 194, denoting a slack condition of crowd rope 147. Engagement of annular members 203 and 203*a* with rollers 216 and 218 will cause levers 212 and 213 to pivot downwardly about the axis of support rod 211, correspondingly causing arm portion **212*b* of lever 212 to move upwardly to the dotted position as illustrated in FIG. 20. Correspondingly, wire rope 210 will be pulled upwardly to actuate actuating mechanism 209**.

Figure 14:
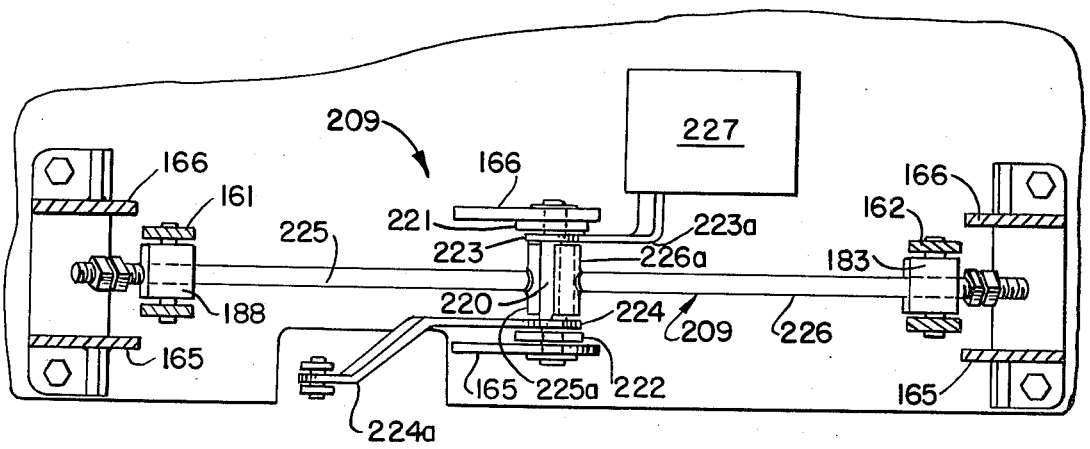
FIG. 14 is a cross-sectional view taken along line 14—14 in FIG. 13.

Actuating mechanism 209 is best illustrated in FIGS. 13 and 14. It consists of a mounting pin 220 provided with a set of bushings 221 and 222 which are adapted to ride in horizontal slots **165*a* and 166*a* in frame panels 165 and 166, a set of crank arms 223 and 224 and a set of connecting rods 225 and 226. Crank member 224 is provided with an arm portion 224*a* which is connected at the free end thereof to wire rope 210. Arm member 223 is provided with an arm portion 223*a* having a counterweight 227 secured to the end thereof. Crank members 222 and 223 also have diametrically opposed arm portions on which there are mounted a set of pins 228 and 229. Connecting rod 226 is provided with a sleeve member 226*a* which is mounted on pin 228. The opposite end of connecting rod 226 projects through collar member 183 pivotally connected to the lower end of brake actuating lever 162, and is provided with a set of stop nuts threaded on the free end thereof. Similarly, connecting rod 225 is provided with a sleeve member 225*a* mounted on pin 229, and has the opposite end thereof projecting through collar member 188 pivotally mounted to the lower end of brake actuating lever 161. A set of stop nuts also are threaded on the free end of connecting rod 225. It thus will be seen that when crank arm portion 224*a* is pivoted downwardly, such motion will be transmitted through connecting rods 225 and 226 to cause brake actuating levers 161 and 162 to pivot toward each other, correspondingly moving brake shoes 159 and 160 into frictional engagement with brake drum 155. Counterweight 227 connected to crank arm portion 223*a* functions to rotate the crank arms in an opposite direction, biasing connecting rods 225 and 226** toward their extended positions out of engagement with the lower ends of the brake actuating levers.

Referring particularly to FIGS. 10, 11 and 17, it will be seen that brake rope 210 is connected at one end to lever 212, extends downwardly alongside brake drum 144 and around a sheave 227 mounted on the deck of the machine, extends laterally and around a second sheave 228 mounted on the deck of the machine below actuating mechanism 209, and extends upwardly where the other end thereof is secured to crank arm portion **224*a***.

Figure 18:
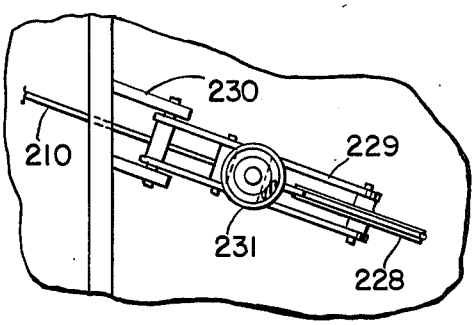
FIG. 18 is a cross-sectional view taken along line 18—18 in FIG. 17.

As best seen in FIGS. 17 and 18, sheave 228 is mounted on the end of a carrier arm 229 pivotally connected to a set of brackets 230 mounted on the deck of the machine. The carrier arm is biased downwardly by a spring 231 anchored on a bracket 232 and acting on the upper side of the carrier arm. The biasing of carrier arm 229 downwardly by its own weight and the weight of spring 231 functions to maintain brake rope 210 taut. Spring 231 functions to attenuate the pull in rope 210, to effect a controlled application of braking force.

In the operation of the crowd system illustrated in FIG. 10, whenever it is desired to crowd the dipper into an enbankment of material being excavated, air cylinder 164 is activated to release the brake assembly for the rope drum. Under such conditions, the front end assembly will pivot forwardly causing the crowd rope to pay out. As long as the front end assembly pivots forwardly at a controlled rate, the crowd rope will be substantially taut, causing crowd rope bail 148 to be positioned forwardly with trunnions 191 and 192 thereof disposed at the forward and upward portions of slots 193 and 194. Upon any disruption of the crowd phase of the digging cycle as when the hoist stalls or the operator ramps down on a hard bottom, crowd rope 147 will begin to become slack, causing bail 148 to fall aided by the biasing action of biasing mechanisms 197 and 198.

As the bail fails, trunnions 191 and 192 will engage rollers 216 and 218 of levers 212 and 213, causing the levers to pivot in a clock-wise direction relative to FIG. 20 thereby pulling brake rope 210 upwardly. Correspondingly, crank arm **224*a* of actuating mechanism 209 will be pivoted downwardly, causing rods 225 and 226 to be pulled together. As the rods move inwardly, the nuts threaded on the ends thereof will engage collar members 183 and 188 to pivot brake actuating levers 161 and 162 toward each other, thus applying the brake to stop further rotation of the rope drum. If the drum is stopped abruptly, overruning clutch 154 allows motor 149 to run in the payout direction without driving gear set train 150**, until such time as the motor can be stopped by electrical means. As soon as the crowd rope becomes taut again, a rope force will be applied on the bail moving it to the upper position thus deactivating the slack prevention system and permitting the rope drum to rotate and pay out crowd rope. When it is desired to retract the dipper, the drive motor is energized to drive the rope drum in the take-up direction.

As a further embodiment of the present invention, in lieu of a backstop mechanism as described in connection with FIGS. 1 through 9, a pawl and ratchet mechanism can be used to restrain rotation of the gear casing in one direction while permitting it to rotate freely in the opposite direction. Such a ratchet mechanism also could be used in lieu of an overriding clutch as described in conjunction with the embodiment shown in FIGS. 10 through 20. It further is contemplated that a brake rope such as brake rope 210 can be operatively connected to a ratchet mechanism operatively connected to the crowd drum for restraining the rotation of the crowd drum in the pay-out direction responsive to a slack condition of the crowd rope, actuated by the fall of the crowd rope bail. A ratchet type system perhaps would be most applicable in smaller machines having smaller crowd drive loads.

The several embodiments of the present invention as described provide a number of advantages over comparable systems in the prior art. Initially, it is to be noted that the present invention prevents slack in the most positive, direct way possible and does not rely upon any other system on the machine such as any electrical or pneumatic system. The invention functions to stop the drum quickly, regardless of the amount of kinetic energy in the drive motor. The system is easy on the motor and the electrical supply system for the motor, not requiring any abnormal quick reversals in preventing slack. The system has a modulated action and tends to maintain a specific minimum rope pull without going into oscillation which is characteristic of an on-and-off type of control system. Furthermore, in view of the absence of any adverse effects on the drive motor and its electrical supply system, and the modulated characteristic of the system, the system does not require any large movement of heavy parts to take up any excess rope length payed out, since such paying out is strictly limited. Finally, it will be appreciated that the system avoids any severe impact and loss of front end control.

From the foregoing detailed description, it will be evident that there are a number of changes, adaptations and modifications of the present invention which fall within the province of those persons having oridinary skill in the art to which the present invention pertains. However, it is intended that all such variations not departing from the spirit of the invention be considered as within the scope thereof as limited solely by the appended claims.

I claim:

1. In a power shovel having a main frame, a front end assembly operatively connected to said main frame and a rope crowd system including a rope drum supported on said main frame, drive means supported on said main frame drivingly connected to said rope drum, a brake operatively connected to said rope drum and a rope wound on said drum and operatively connected to said front end assembly, a system for preventing said rope from becoming slack comprising means responsive to an impending slack condition of said rope for actuating said brake drum thereby preventing continued pay out of said rope by said drum.

2. A system according to claim 1 further comprising a movable rope anchoring member and wherein said brake actuating means is responsive to a predetermined disposition of said movable rope anchoring member effected by an impeding slack condition of said rope.

3. A system according to claim 2 wherein said rope anchoring member comprises a bail secured to a free end of said rope, movable in a slot formed in a support member.

4. A system according to claim 3 wherein said slot is inclined so that said bail will be caused to fall toward a lower end thereof when the rope is in an impending slack condition, and wherein said brake actuating means includes a mechanical system responsive to said bail being displaced away from the upper end of said slot for actuating said brake.

5. A system according to claim 4 wherein said mechanical system includes a lever actuated by said bail disposed in the lower end of said slot, and a mechanical linkage for translating the pivotal motion of said lever when engaged by said bail to a braking action of said drum.

6. A system according to claim 1 including means responsive to a direction of torque of said drive means in a pay-out direction for disengaging said drive means from said rope drum, allowing said drive means to operate in a pay-out direction when said brake is actuated.

7. A system according to claim 6 wherein said brake actuating means is responsive to a predetermined disposition of a movable rope anchoring member effected by an impending slack condition of said rope.

8. A system according to claim 7 wherein said rope anchoring member comprises a bail secured to a free end of said rope, movable in a slot formed in a support member.

9. A system according to claim 8 wherein said slot is inclined so that said bail will be caused to fall toward a lower end thereof when the rope is in a slack condition, and wherein said brake actuating means includes a mechanical system responsive to said bail being displaced away from the upper end of said slot for actuating said brake.

10. A system according to claim 9 wherein said mechanical system includes a lever actuated by said bail disposed in the lower end of said slot, and a mechanical linkage for translating the pivotal motion of said lever when engaged by said bail to a braking action of said drum.

11. A system according to claim 6 wherein said drive disengaging means comprises a backstop.

12. A system according to claim 6 wherein said drive disengaging means comprises a clutch.

13. A system according to claim 6 wherein said drive disengaging means comprises an overrunning clutch.

14. In a power shovel having a main frame, a front end assembly operatively connected to said main frame and a rope crowd system including a rope drum supported on said main frame, drive means supported on said main frame drivingly connected to said rope drum, a brake operatively connected to said rope drum and a rope wound on said drum and operatively connected to said front end assembly, a device for abating a slack condition of said rope comprising means responsive to a direction of torque of said drive means when paying out rope for disengaging said drive means from said drum.

15. A device according to claim 14 wherein said drive disengaging means comprises a backstop mechanism.

16. A device according to claim 14 wherein said drive disengaging means comprises a clutch.

17. A device according to claim 14 wherein said drive disengaging means comprises an overrunning clutch.

18. In a power shovel having a main frame, a front end assembly operatively connected to said main frame and a rope crowd system including a rope drum supported on said main frame, a drive motor supported on said main frame, a planetary gear set including a sun gear, a ring gear and a plurality of planetary gears mounted on a carrier, a first of said planetary gear set components being drivingly connected to said drive motor, a second off said planetary gear set components being drivingly connected to said drum and a third reaction component being supported on said main frame, a brake drum mounted on said gear set component drivingly connected to said rope drum, and a rope wound on said drum and operatively connected to said front end assembly, a system for preventing said rope from becoming slack comprising a friction member engageable with said brake drum for arresting the rotation thereof and means responsive to an impending slack condition of said rope for causing said friction member to engage said brake drum to provide a braking action thereby preventing continued pay out of said rope by said drum.

19. A system according to claim 18 wherein said means responsive to an impending slack condition is responsive to a predetermined disposition of a movable rope anchoring member effected by an impending slack condition of said rope.

20. A system according to claim 19 wherein said rope anchoring means comprises a bail secured to a free end of said rope, movable in a slot formed in a support member.

21. A system according to claim 20 wherein said slot is inclined so that said bail will be caused to fall to a lower end thereof when the rope is in an impending slack condition, and wherein said brake actuating means includes a mechanical system responsive to said bail being disposed at the lower end of said slot for actuating said brake.

22. A system according to claim 21 wherein said mechanical system includes a lever actuated by said bail disposed in the lower end of said slot, and a mechanical linkage for translating the pivotal motion of said lever when engaged by said bail to a braking action of said drum.

23. A system according to claim 18 including a shaft drivingly interconnecting the planetary gear carrier of said gear set and said rope drum, and wherein said brake drum is mounted on said shaft.

24. A system according to claim 18 including means responsive to a slack condition of said rope for disengaging said drive motor from said rope drum.

25. A system according to claim 24 wherein said drive disengaging means comprises means for restraining rotation of the reaction component of said gear set in one direction to permit the transmission of driving torque to said rope drum for taking in rope and permitting rotation of said reaction component in the opposite direction to preclude the transmission of driving torque to said rope drum for paying out rope.

26. A system according to claim 25 wherein said drive disengaging means comprises a backstop mechanism operatively supported on said main frame and operatively connected to said reaction component of said gear set.

27. A system according to claim 24 wherein said drive disengaging means comprises a clutch.

28. A system according to claim 24 wherein said drive disengaging means comprises an overrunning clutch.

29. In a power shovel having a rope crowd system including a rope drum and a drive motor, a drive assembly comprising a planetary gear set including a driven component drivingly connected to said drive motor, a drive component drivingly connected to said rope drum and a reaction component rotatably mounted on a support frame and a backstop mechanism mounted on said support frame and operatively connected to said reaction member whereby said reaction component will be restrained from rotation in one direction to transmit drive from said drive motor to said rope drum and will be permitted to rotate in the opposite direction to disengage said drive motor from said rope drum.

30. A drive assembly according to claim 29 wherein said driven component comprises a sun gear, said drive component comprises a plurality of planetary gears mounted on a carrier and said reaction component comprises a ring gear mounted on a gear case rotatably mounted on said support frame, and wherein said backstop mechanism is operatively connected to said gear case supporting said ring gear component.

31. A drive assembly according to claim 29 wherein said backstop mechanism comprises a carrier member mounted on said support frame, and a plurality of circumferentially spaced shoes pivotally mounted on said carrier member and engageable with a circular surface on said reaction component, each of said shoes having means for yieldingly biasing said shoes into frictional engagement with said reaction component when said reaction component seeks to rotate in one direction whereby said reaction component will be restrained from rotation in said one direction and free to rotate in the opposite direction.

32. A drive assembly according to claim 31 wherein an arm portion of said carrier member is pivotally connected to said support frame.

33. A drive assembly according to claim 32 wherein said shoes are equidistantly spaced circumferentially and one shoe is omitted on a side of said carrier member opposite the side thereof connected to said support frame, relative to the reaction component.

34. A drive assembly according to claim 31 wherein an arm portion of said carrier member is pivotally connected to said support frame through a link.

35. A drive assembly according to claim 34 wherein said shoes are eqidistantly spaced circumferentially and one of said shoes otherwise disposed substantially parallel with said link on a side of said carrier member disposed opposite the side thereof provided with said link, relative to said reaction component, is omitted.

36. A drive assembly according to claim 31 wherein said reaction component comprises a ring gear mounted on a gear casing rotatably mounted on said support frame and said shoes are received in an annular groove on said gear casing.

* * * * *